US008685232B2

(12) United States Patent
Mandal et al.

(10) Patent No.: US 8,685,232 B2
(45) Date of Patent: Apr. 1, 2014

(54) FLUID CATALYTIC CRACKING (FCC) PROCESS FOR MANUFACTURING PROPYLENE AND ETHYLENE IN INCREASED YIELD

(75) Inventors: Sukumar Mandal, Digvijaygram (IN); Asit Kumar Das, Digvijaygram (IN); Ashwani Yadav, Digvijaygram (IN); Manoj Yadav, Digvijaygram (IN); Akhilesh Bhatnagar, Digvijaygram (IN); Rajeshwar Dongara, Vadodara (IN); Veera Venkata Satya Bhaskara Sita Rama Murthy Katravulapalli, Vadodara (IN)

(73) Assignee: Reliance Industries Limited, Mumbai (IN)

( * ) Notice: Subject to any disclaimer, the term of this patent is extended or adjusted under 35 U.S.C. 154(b) by 121 days.

(21) Appl. No.: 13/133,759

(22) PCT Filed: Dec. 8, 2009

(86) PCT No.: PCT/IN2009/000708

§ 371 (c)(1),
(2), (4) Date: Jun. 9, 2011

(87) PCT Pub. No.: WO2010/067379

PCT Pub. Date: Jun. 17, 2010

(65) Prior Publication Data

US 2011/0240523 A1 Oct. 6, 2011

(30) Foreign Application Priority Data

Dec. 10, 2008 (IN) ..... 2569/MUM/2008

(51) Int. Cl.

| | |
|---|---|
| ***C10G 11/18*** | (2006.01) |
| ***C10G 11/00*** | (2006.01) |
| ***C07C 4/06*** | (2006.01) |
| ***C07C 4/02*** | (2006.01) |

(52) U.S. Cl.

USPC ..... 208/118; 208/46; 208/106; 208/113; 585/500; 585/648; 585/653

(58) Field of Classification Search

USPC ..... 208/46, 106, 113, 118; 502/60, 71, 77, 502/79; 585/500, 648, 653

See application file for complete search history.

(56) References Cited

U.S. PATENT DOCUMENTS 5,670,037 A * 9/1997 Zaiting et al. ..... 208/114

(Continued)

FOREIGN PATENT DOCUMENTS

| | | |
|---|---|---|
| EP | 1555308 | 7/2005 |
| WO | WO2007/019797 | 2/2007 |

OTHER PUBLICATIONS

Parkash, S, Refining Processes Handbook, 2003, Gulf Publishing, pp. 109-152.*

International Search Report from the Australian Patent Office dated Jan. 24, 2011 for International Application No. PCT/IN2009/000708.

(Continued)

*Primary Examiner* — Walter D Griffin

*Assistant Examiner* — Derek Mueller

(74) *Attorney, Agent, or Firm* — Klein, O'Neill & Singh, LLP

(57) ABSTRACT

Manufacture of propylene and ethylene in a FCC unit. Each FCC riser comprises an acceleration zone, a lift stream feed nozzle, a main hydrocarbon stock feed nozzle, and an olefinic naphtha feed nozzle. Mixed FCC catalyst comprising at least 2 percent by weight pentasil zeolite and at least 10 percent by weight Y-zeolite is injected at the bottom of each FCC riser. Olefinic naptha is injected through the olefinic feed nozzle, main hydrocarbon stock is injected through the main hydrocarbon stock feed nozzle and lift stream is injected through the lift stream feed nozzle. Lift stream comprises olefinic $C_4$ hydrocarbon stream and optionally steam and/or a fuel gas. Olefinic $C_4$ hydrocarbon steam is cracked in the acceleration zone at 600 to 800° C., 0.8 to 5 kg/cm$^2$ (gauge) pressure, WHSV 0.2 to 100 hr up 1 and vapour residence time 0.2 to 5 seconds.

12 Claims, 1 Drawing Sheet

(56) References Cited

U.S. PATENT DOCUMENTS

| | | | | |
|---|---|---|---|---|
| 6,153,089 | A | 11/2000 | Das et al. | |
| 2001/0056216 | A1 * | 12/2001 | Sha et al. | 585/650 |
| 2009/0288990 | A1 | 11/2009 | Xie et al. | |

OTHER PUBLICATIONS

Written Opinion from the Australian Patent Office dated Jan. 24, 2011 for International Application No. PCT/IN2009/000708.

* cited by examiner

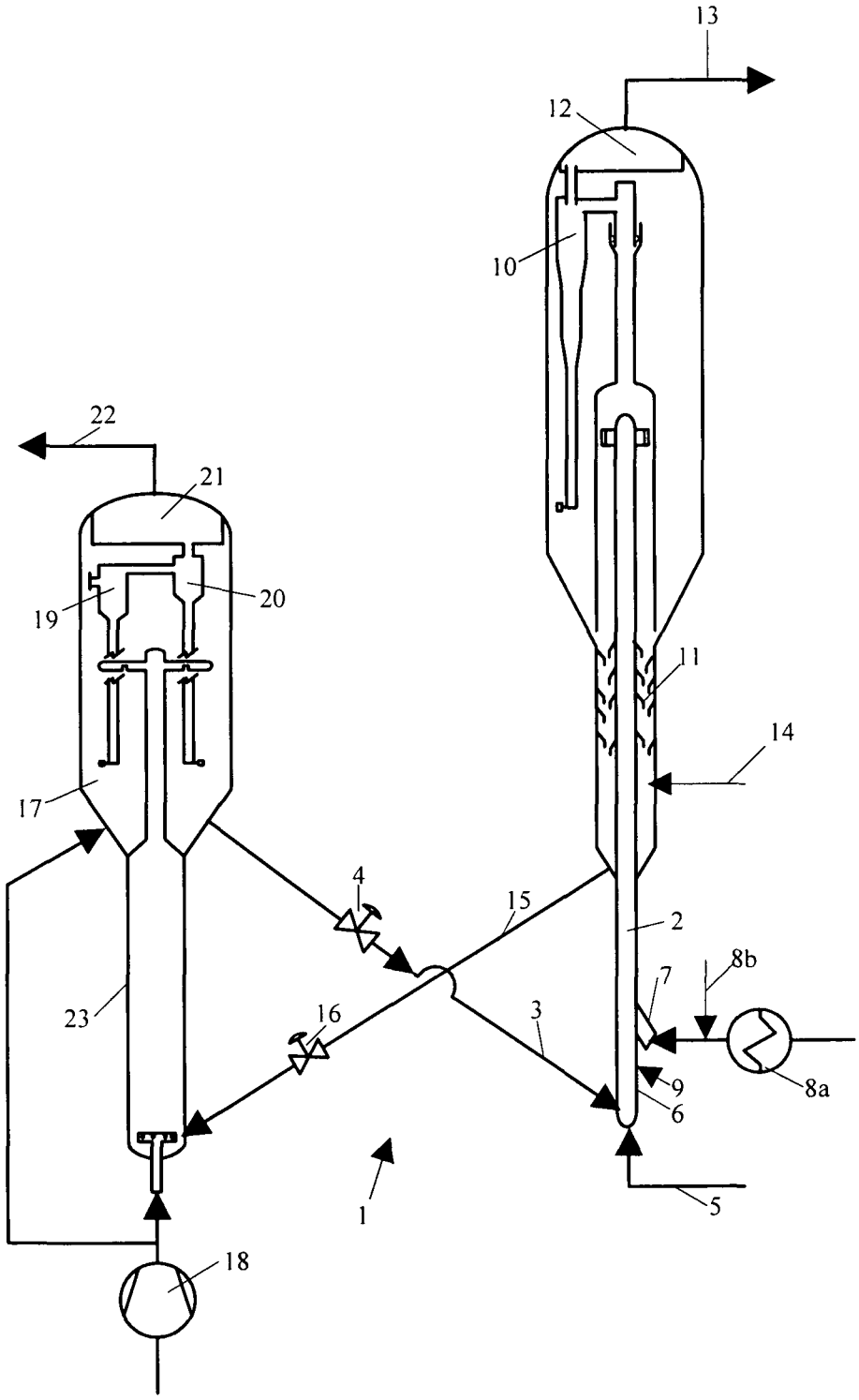
13
12
10
22
21
19
20
11
14
17
4
15
2
8b
7
23
16
3
9
8a
6
1
5
18

FLUID CATALYTIC CRACKING (FCC) PROCESS FOR MANUFACTURING PROPYLENE AND ETHYLENE IN INCREASED YIELD

FIELD OF THE INVENTION

This invention relates to a fluid catalytic cracking (FCC) process for manufacturing propylene and ethylene in high yield.

BACKGROUND OF THE INVENTION

Propylene is one of the fastest growing petrochemicals primarily because of the high growth rate of polypropylene. Studies show that the worldwide demand for propylene has been increasing at an annual average rate of 5.7% since 1991. In the year 2000, propylene production was about 52 million tones and it is projected that the demand will grow to 84 million tones by the year 2010. Typically, about 70% of this propylene is generated by steam cracker, 28% by refinery fluid catalytic cracking (FCC) units, and 2% by on-purpose processes like propane dehydrogenation or metathesis. The growth rate of the propylene demand has significantly outpaced the demand for ethylene growth rate, which is also produced from steam cracker. As a result, the construction of new steam crackers to meet the increasing ethylene demand alone or also will not be sufficient to satisfy the growing propylene demand. To make up for this shortfall, other propylene supply sources will be required. Therefore, additional emphasis is being given on recovering propylene from FCC units involving the addition of ZSM-5 catalyst and new technologies such as DCC (Deep Catalytic Cracking), high severity FCC riser cracking e.g. Indmax, PetroFCC or on-purpose processes such as propane dehydrogenation, metathesis olefinic naphtha cracking technologies (MOI, Superflex, Propylur or PCC). The capability of on-purpose processes is not enough to match the growth of propylene demand. This means that the market demand for propylene has to be met from other processes like FCC or new technology such as DCC (Deep Catalytic Cracking) or Indmax. In order to increase propylene yield through DCC, Indmax, Superflex or PCC technologies, refiners need to invest for setting up new units.

U.S. Pat. No. 6,977,321 describes a process for the production of propylene from cracking of olefinic feedstock on crystalline silicate catalyst comprising an MFI (Meet Flow Index) structure having silicon/aluminum ratio within the range of 180 to 1000. It is carried out at a temperature of 500 to 600° in two parallel swing reactors. It is capable of processing only lighter hydrocarbons. Higher silica/alumina ratio catalyst employed has lower activity which leads to fluctuation of product selectivity while it operates in swing reactor mode. U.S. Pat. No. 5,043,522 describes conversion of predominantly paraffinic feedstock on ZSM-5 zeolite catalyst to $C_2$ to $C_3$ olefins. In this process even at very high reaction temperature and very low reactor pressure per pass conversion is very low (30 to 40%). Moreover, the reactor configuration used for the process is not disclosed, which is very important for obtaining sustained yield and product selectivities. U.S. Pat. No. 6,222,087 describes a process for converting $C_4$ to $C_7$ paraffin and olefins to ethylene and propylene by using ZSM-5 catalyst and/or ZSM-11. This process is carried out only in dense fluidized bed reactor or fixed-bed swing reactor. The example described in this patent shows the formation of good amount of BTX (benzene, tolune, xylene) while processing butane-1 or the like feed due to predominant oligomization reaction. Further, propylene production and conversion are not high when LCN is processed. U.S. Pat. Nos. 5,043,522 and 5,171,921 describe a process for the production of $C_2$-$C_5$ olefins from higher olefinic or paraffinic or mixed olefins and paraffin feedstock over steam activated catalyst containing phosphorus and H-ZSM-5. As the coke yield is less than 0.5 wt % of the feed, heat necessary to maintain the reaction is to be provided by separately heating the catalyst particles in a fluidized regeneration zone for instance by combustion of appropriate fuel hydrocarbon. A main drawbacks of this process is that the catalyst deactivates very quickly while the fuel burns in the regenerator for supplying heat for the process. U.S. Pat. No. 6,951,968 discloses a process for converting the less valuable olefins present in refinery and petrochemical plants as a feedstock. It catalytically converts olefins into light olefins and in particular propylene, over an MFI (Melt Flow Index) crystalline silicate catalyst having silicon/aluminum aiomic ratio of 300 to 1000. The catalytic activity of this catalyst is very low as acid density is very low. The catalyst has a very high silica/alumina ratio as against catalysts used in typical FCC units where silica/alumina is in the range of 25 to 50. The process is mainly for use in moving bed reactor like catalytic reforming reactor where large quantity of heat needs to be supplied to maintain reaction temperature between 500 to 600° C. The above processes are essentially for making light olefins from $C_4$ or higher hydrocarbon streams by using mainly ZSM-5 catalyst and fixed bed swing type or moving bed type reactor configuration. The reaction temperature is achieved by burning separate fuel. U.S. Pat. No. 7,323,099 describes a process for selectively producing $C_2$ to $C_4$ olefins from feedstock such as gas oil or resid. The feedstock is reacted in a first stage comprising a fluid catalytic cracking unit wherein it is converted in the presence of a mixture of conventional large pore zeolite catalyst and a medium pore zeolite catalyst to reaction products including naphtha boiling range stream. The naphtha boiling range stream is introduced into a second stage where it is contacted with a catalyst containing from about 10 to about 50 wt % of a crystalline zeolite having an average pore diameter less than about 0.7 nanometers at reaction conditions which include temperatures ranging from about 500 to about 650° C. and a hydrocarbon partial pressure from about 10 to about 40 psia. This process requires essentially two independent FCC units, wherein heavy feed cracked in the first riser in the presence of larger pore Y zeolite catalyst and medium pore zeolite like ZSM-5 and naphtha product from the first FCC unit, is further cracked in a second riser in the presence of a second catalyst containing medium pore zeolite catalyst mostly. Each of these risers has a lift zone where typically steam is used as lift medium. U.S. Pat. No. 4,830,728 discloses a FCC process that has two separate risers in which heavy feed/VGO (vacuum gas oil) cracked in first riser in the presence of catalyst mixture containing mainly large pore crystalline silicate zeolite and medium pore ZSM-5 type and ethylene rich material is introduced to a second riser at a lower level to produce heavier products in the presence of shape selective catalyst. Naphtha is also introduced into the second riser at a higher level thereby producing high octane gasoline. The lift zone of the second riser is used to carry out exothermic oligomerization reaction for converting ethylene to heavier products to maximize high octane gasoline. US 20,080,035,527 describes a dual riser FCC process for converting naphtha, mixed $C_4$ stream or the like to ethylene and propylene in the presence of an FCC catalyst. This process requires coke precursor or auxiliary fuel to satisfy the heat balance of the unit for converting light hydrocarbon stream. It relates to cracking of light and heavy naphtha streams in different risers so that cracking severity can be adjusted separately in each riser depending on the cracking severity requirement. Butadiene is used to let down more coke on the catalyst in the riser or fuel gas or fuel oil is used in the regenerator to supply supplemental heat. US 20,060, 108,261 describes a process for converting naphtha in FCC type configuration using ZSM-5 family catalyst. It also describes improvement in propylene making by recycling $C_4$ fraction to a dilute phase reaction zone to separate the dense phase stripping zone. US 20, 0401,082,745 and WO 2,004, 078,881 relate to sequential cracking of $C_6$ lean and rich fraction in one or more fixed bed reactors for making propylene in the presence of medium pore zeolite and silico alumino phosphate. EP 1,555,308 discloses recycle of naphtha at the lift zone of a FCC unit riser. However, it emphasizes that naphtha cracking in separate risers is advantageous. The above processes in general teach conversion of olefinic naphtha feedstock or $C_4$ or higher olefinic hydrocarbon feedstock to light olefin particularly propylene over MFI (Melt Flow Index) crystalline silicate catalyst in fluid bed or dense bed or fixed bed with swing reactor or dual riser system. Heat balance is satisfied by using supplementary fuel supply. It is also known in the prior art processes to recycle light olefinic naphtha at the riser bottom for increasing $C_2$ to $C_4$ olefins irrespective of the preferred length of lift zone which is to provide optimum vapour residence time, weight hourly space velocity or the like. The lift steam is used to keep the catalyst above choking velocity. However, lift steam causes deactivation and attrition of the catalyst as regenerated catalyst comes in contact with steam at very temperature in the range of 690 to 740° C. Steam also increases water generation in the reaction. Fluid catalytic cracking technology is used in refineries to crack light olefin rich hydrocarbons stock with naphtha. A typical FCC unit comprises at least one riser having an acceleration zone or lift zone at the lower portion thereof, a lift stream feed nozzle at the bottom thereof and a light olefinic hydrocarbon stock feed nozzle above the lift stream feed nozzle in spaced apart relationship. The riser optionally comprises an olefinic naptha feed nozzle at a location along the acceleration zone. A lift stream comprising lift steam or inert lift flue gases like refinery fuel gas or combination thereof is introduced through the lift stream feed nozzle at the bottom of the riser. An olefinic rich hydrocarbon stock is introduced into the riser through the hydrocarbon stock feed nozzle. The catalyst is fed into the riser bottom from the regenerator. Naptha is optionally fed into the riser along with the lift stream or through the naptha feed nozzle. Catalytic cracking of the hydrocarbon stock and naptha, if any, take place in the riser. (Fluid Catalytic Cracking Handbook Design, Operation, and Troubleshooting of FCC Facilities by Reza Sadeghbeigi, Gulf Publishing Company, Houston. Tex., 1995)

It is advantageous and desirable to increase the yield of propylene and ethylene obtained by fluid catalytic cracking (FCC) process in a given FCC unit without increasing the capacity of the FCC unit or without any hardware alterations in the FCC unit, reduce hydrothermal deactivation and attrition of the catalyst and water formation during production of propylene and ethylene in the FCC unit, crack the hydrocarbon feed stock at appropriate severity to maximize yields of diesel, gasoline, LPG (liquefied petroleum gas), propylene, ethylene or combination thereof in the FCC unit and use only olefinic C4 hydrocarbon in the lift stream to improve the equilibrium catalyst activity by at least 5 wt % for constant catalyst make up rate. There is, therefore, a need for realizing such advantages and benefits.

OBJECTS OF THE INVENTION

An object of the invention is to provide a fluid catalytic cracking (FCC) process for manufacturing propylene and ethylene in increased yield in a given FCC unit without increasing the capacity of the FCC unit or without any hardware alterations in the FCC unit.

Another object of the invention is to provide a fluid catalytic cracking (FCC) process for manufacturing propylene and ethylene in increased yield in an FCC unit which process reduces hydrothermal deactivation and attrition of the catalyst and water formation during production of propylene and ethylene.

Another object of the invention is to provide a fluid catalytic cracking (FCC) process for manufacturing propylene and ethylene in increased yield in an FCC unit which process cracks the hydrocarbon feed stock at different severity to maximize yields of diesel, gasoline, LPG (liquefied petroleum gas), propylene, ethylene or combination thereof.

Another object of the invention is to provide a fluid catalytic cracking (FCC) process for manufacturing propylene and ethylene in increased yield in an FCC unit which process uses only olefinic C4 hydrocarbon in the lift stream to improve the equilibrium catalyst activity by at least 5 wt % for constant catalyst make up rate.

DETAILED DESCRIPTION OF THE INVENTION

According to the invention there is provided a fluid catalytic cracking (FCC) process for manufacturing propylene and ethylene in increased yield, comprising cracking an olefinic naphtha stream and main hydrocarbon stock in combination with an olefinic $C_4$ hydrocarbon stream on a mixed FCC catalyst in different zones of one or more risers of an FCC unit, wherein each FCC riser comprises an acceleration zone at the lower portion thereof, a lift stream feed nozzle at the bottom of the acceleration zone, a main hydrocarbon stock feed nozzle above the acceleration zone and an olefinic naphtha feed nozzle at a location along the acceleration zone between the lift stream feed nozzle and main hydrocarbon stock feed nozzle, and wherein the catalyst comprises at least 2 percent by weight pentasil zeolite and at least 10 percent by weight Y-zeolite and, is injected at the bottom of each FCC riser, the olefinic naptha is injected through the olefinic feed nozzle, the main hydrocarbon stock is injected through the main hydrocarbon stock feed nozzle and the lift stream is injected through the lift stream feed nozzle at the bottom of the acceleration zone and wherein, the lift stream comprises the olefinic $C_4$ hydrocarbon stream with or without steam and/or a fuel gas and wherein the olefinic $C_4$ hydrocarbon steam is cracked in the acceleration zone at 600 to 800° C. and pressure of 0.8 to 5 kg/cmup2 (gauge) and weight hourly space velocity (WHSV) of 0.2 to 100 hr up 1 and vapour residence time of 0.2 to 5 seconds.

According to the invention there is also provided a fluid catalytic cracking (FCC) process for manufacturing propylene and ethylene in increased yield, comprising cracking a main hydrocarbon stock in combination with an olefinic $C_4$ hydrocarbon stream on a mixed FCC catalyst in different zones of one or more risers of an FCC unit, each FCC riser comprising an acceleration zone at the lower portion thereof, a lift stream feed nozzle at the bottom of the acceleration zone and a main hydrocarbon stock feed nozzle above the acceleration zone and wherein the catalyst comprises at least 2 percent by weight pentasil zeolite and at least 10 percent by weight Y-zeolite and is injected at the bottom of each FCC riser, the main hydrocarbon stock is injected through the main hydrocarbon stock feed nozzle and the lift stream is injected through the lift stream feed nozzle at the bottom of the acceleration zone and wherein the lift stream comprises the olefinic $C_4$ hydrocarbon stream with or without a fuel gas and wherein the olefinic $C_4$ hydrocarbon steam is cracked in the acceleration zone at 600 to 800° C. and pressure of 0.8 to 5 kg/cmup2 (gauge) and weight hourly space velocity (WHSV) of 0.2 to 100 hr up 1 and vapour residence time of 0.2 to 5 seconds.

Preferably the olefinic $C_4$ hydrocarbon stream is 5 to 15 wt % of the main hydrocarbon stock with a minimum olefin content of 30 vol % in the olefinic $C_4$ hydrocarbon stream to achieve minimum incremental yield of propylene by 0.5 to 3 wt % and ethylene by 0.3 to 0.8 wt %. Preferably the olefinic $C_4$ hydrocarbon stream is from fluid catalytic cracking (FCC) unit, coker, vis-breaker or $C_4$ raffinate from naphtha steam cracker or pure C4 olefin stream or combination thereof. The olefinic $C_4$ hydrocarbon stream is cracked in the acceleration zone of each FCC riser preferably at weight hourly space velocity (WHSV) of 1 to 40 hr up-1, still preferably WHSV of 20 to 30 hr up-1, still preferably WHSV of 2 to 20 hr up-1, and preferably at 600 to 750° C., still preferably at 680 to 720° C. Preferably the olefinic naphtha has olefin content of at least 20 percent by volume and comprises olefin rich sources from fluid catalytic cracking (FCC) or coker or naphtha cracker gasoline. Preferably the main hydrocarbon stock comprises gas oil (boiling point 120 to 360° C.), vacuum gas oil (boiling point 360 to 600° C.) and long or short hydrocarbon residues (boiling above 360° C. and 600° C. respectively) or mixture thereof. Preferably the main hydrocarbon stock comprises hydro-treated or untreated vacuum gas oil and/or petroleum residue selected from wax, fatty oil or plastics or combination thereof. Preferably the mixed FCC catalyst comprises pentasil zeolite, preferably 7 to 15 percent by weight and Y zeolite, preferably 20 to 30 percent by weight and the pentasil zeolite is preferable ZSM-5 zeolite. Preferably the main hydrocarbon stock is cracked at different severity to maximize yields of diesel, gasoline, LPG (liquefied petroleum gas), propylene, ethylene or combination thereof. Preferably the lift stream comprises only olefinic C4 hydrocarbons steam to improve the equilibrium catalyst activity by at least 5 wt % for constant catalyst make up rate.

The following is a detailed description of the invention with reference to the accompanying drawings, in which the sole FIG. 1 is a schematic view of an FCC unit for carrying out the process of the invention according to an embodiment thereof. The FCC unit 1 as illustrated in FIG. 1 of the accompanying drawings comprises a riser 2, which is connected to a regenerated catalyst stand pipe (RCSP) 3 at the bottom thereof. Regenerated catalyst (not shown) flows into the riser bottom 2 through the stand pipe 3 and regenerated catalyst slide valve 4 (RCSV). The catalyst is lifted by a lift steam fed into the riser through the lift stream feed nozzle 5 provided at the bottom of the riser. The lift stream comprises an olefinic C4 hydrocarbon stream with or without steam and/or a fuel gas. 6 is the acceleration zone or lift zone of the riser between the lift stream feed nozzle and main hydrocarbon stock feed nozzle 7. The main hydrocarbon stock is introduced into the riser through feed nozzle 7. The preheater and atomizing steam supply line to the hydrocarbon stock are marked 8*a* and 8*b* respectively. 9 is an olefinic naptha feed nozzle provided with the riser at the acceleration zone between the lift stream feed nozzle and hydrocarbon stock feed nozzle. The naphtha introduced in the acceleration zone and the olefinic $C_4$ hydrocarbon steam injected at the bottom of the riser via feed nozzle 5 are effectively cracked in the acceleration zone. Contact with hot regenerated catalyst vaporizes the hydrocarbon stock and the mixture of hot catalyst and oil vapors travels up the riser. Cracking reactions occur as the hydrocarbon stock vapour and catalyst flow up the riser. Overall these reactions are endothermic and thus the temperature in the riser decreases as the reaction progresses. At the end of the riser, the product vapours and the catalyst flow through a riser termination device/reactor cyclone 10 which separates the catalyst from the hydrocarbon vapours. Catalyst separated in the riser termination device/reactor cyclone flows into the spent catalyst stripper 11. The hydrocarbon vapours from the riser termination device/reactor cyclone and steam along with hydrocarbons vapours leaving the spent catalyst stripper flow through the reactor plenum 12 and into the reactor vapour line 13. Thereafter, these vapours (products) enter the main fractionator (not shown) followed by gas concentration section (not shown) for separation into different products like fuel gas, LPG (liquefied petroleum gas), gasoline (cracked naphtha), light cyclone oil (LCO) or clarified slurry oil (CSO). The catalyst in cyclone 10 flows into spent catalyst stripper 11. This catalyst still contains a considerable volume of product vapours. In the stripper 11, the catalyst is contacted with steam via steam supply line 14 which displaces the hydrocarbon vapours. The bulk of the steam is injected at the bottom of the stripper and flows upward through the stripper while the spent catalyst flows downward. Steam and stripped hydrocarbons flow out through the top of the stripper and mix with product vapors leaving the cyclone 10. Coke laden catalyst from the stripper goes to regenerator 17 via combustor 23 for regeneration through spent catalyst stand pipe (SCSP) 15 and spent catalyst slide valve (SCSV) 16. The SCSV 16 controls the flow of spent catalyst to regenerator and thus the stripper bed level. In the combustor and regenerator the spent catalyst is contacted with air from the main air blower 18. The catalyst and air well mixed in a fluid bed regenerator or fast fluid bed combustor and the carbon (coke) deposited on the catalyst during the cracking reaction is burned off in the regenerator. The heat produced by the combustion of the coke deposits raises the temperature of the catalyst. Flue gases leaving the regenerator catalyst bed pass through the regenerator cyclones 19, 20 where entrained catalyst is removed and returned to the regenerator bed. Flue gases leaving the cyclones 19, 20 pass through the regenerator plenum 21 and into flue gas system 22. The regenerated catalyst slide valve (RCSV) 4 controls the quantity of hot catalyst entering the riser and thus the riser outlet temperature. Alternatively the process is carried out by injecting a lift stream through the lift stream feed nozzle at the bottom of the riser and main hydrocarbon stock through the main hydrocarbon feed nozzle, wherein the lift stream comprises only the olefinic C4 hydrocarbon stream with or without a fuel gas. In such a process variation the olefinic naptha feed nozzle is not required. The invention thus makes use of the acceleration zone for cracking the olefinic C4 hydrocarbon stream and increasing yield of propylene and ethylene in a given FCC unit without any hardware changes in the FCC unit. Further it replaces steam as a lift stream or substantially replaces steam as a lift stream keeping the catalyst above choking velocity so as to reduce hydrothermal deactivation and attrition of the catalyst. Water formation during the production of propylene and ethylene is substantially reduced because of the use of reduced amount of steam or elimination of steam.

Any FCC unit operates under different hardware constraints like reactor and regenerator cyclone velocity or main air blower (MAB) speed. Therefore, any incremental yield, particularly propylene by using better catalyst/additive is not possible unless it cuts the feed throughput or reduces the molar equivalent of other products in the riser-reactor side. However, refineries are having propylene separation unit (PRU) or PRU integrated with petrochemical complex for making polypropylene are trying hard to get extra propylene. Moreover, other refiners having no facilities for propylene separation are trying hard to make more LPG. Therefore, any development that gives extra propylene or LPG from existing units will give extra value addition. FCC unit converts primarily heavy feeds (such as vacuum gas oils, reduced crude, atmospheric tower bottoms, vacuum tower bottoms or the like) into transportation fuel products (such as gasoline, diesel, heating oils or liquefied petroleum gases). To increase yields from the FCC unit of more valuable petrochemical feedstock, such as ethylene and propylene, refineries are operating at high severity and/or using light feed stocks such as light cracked naphtha in the riser to co-crack with heavy feeds. The light cracked or olefinic naphtha is introduced at the bottom of the riser acceleration zone along with lift steam irrespective of length of acceleration zone and catalyst in it. In accordance with the process of the invention, the riser bottom condition is good for the hydrocarbon streams which needs more sever conditions than recycle naphtha stream. For example, olefinic $C_4$ hydrocarbon stream is less crackable or in other words, it needs higher reaction severity. In the present invention, it could be found that introduction of olefinic $C_4$ hydrocarbon stream at the riser bottom gives more than 25% propylene with lower dry gas. This feedstock may be introduced in various quantities, replacing full or partial quantity of lift steam at the riser bottom. As the molecular weight of steam is about one-third of that of olefinic $C_4$ hydrocarbon stream, the FCC unit uses 2%, for example, of fresh feed as steam and can process more than 4 wt % of fresh feed as olefinic $C_4$ hydrocarbon stream without affecting hardware constraints like, reactor cyclone velocities. The olefinic $C_4$ hydrocarbon stream may be any kind of olefins containing $C_4$ hydrocarbon ranging. These olefins may be normal or branched or mixture thereof. However, normal olefins are most preferable. The sources of olefinic $C_4$ hydrocarbon are FCC, coker, visbreaker or $C_4$ raffinate after removal of 1, 3 butadiene from steam cracker. The $C_4$ olefin content in $C_3$ to $C_4$ stream from FCC, coker, visbraker where no separation between $C_3$ and $C_4$ is performed is in the range of 50 to 70 wt %. Whereas, if $C_3$ and $C_4$ stream are separated, the $C_4$ content in $C_4$ stream is in the range of 80 to 90%. The $C_4$ raffinate after removal of 1, 3 butadiene, from naphtha steam cracker contains $C_4$ olefins in the range of 70 to 85%. The $C_4$ olefins with some amount of $C_5$ and $C_6$ olefin rich cuts are also within the scope of the invention. The hydrocarbon feedstock for the present invention may comprise a mixture of one or more of the above described feedstock streams. It was found that the conversion of $C_4$ olefin stream to propylene is in the range of 15 to 30% depending on the riser bottom condition. It was also found that this olefins also oligomarize to about 2-6% gasoline range compound. As the coke from $C_4$ olefin cracking is very less, the coke on catalyst before meeting the hydrocarbon stock feed is in the range of 0.05 to 0.1 wt %. As a result, catalyst doses not deactivate while meeting with fresh VGO (vacuum gas oil) or heavy feedstock. Moreover, residual coke on catalyst in the range of 0.05 to 0.1 wt % does reduce dry gas make from cracking of VGO or heavy feedstock, as this coke preferentially sits on very high active acid sites which otherwise make more coke and dry gas. Further, according to the invention, cracking of olefins in hydrocarbon stream is carried out at riser acceleration zone which is prior to the main hydrocarbon stock feed nozzle, into lighter olefins and selectively into propylene. In accordance with the process of the invention, light cracked naphtha (LCN) injected right at the bottom produces very high undesirable dry gas consisting of hydrogen, methane, ethane and ethylene, since ethylene is not recovered in most FCC units. The undesirable dry gas make can be dropped considerably with improvement in propylene selectivity to about 25 to 30% if light cracked naphtha is introduced at relatively higher elevation within the riser bottom zone. This is because of the temperature of regenerated catalyst at riser bottom is typically in the range of 690° C. to 740° C. Moreover, when using about 2 wt % of LCN recycle, the weight hourly space velocity (WHSV) is in the range of 2 to 5 hr up 1 only and hence vapour residence is very high. It is found that this severity is more than required for LCN cracking and hence LCN over cracks mostly to dry gas. It was observed that optimum WHSV for LCN should be more 20 hr up 1 at riser bottom conditions. This could be achieved in the FCC units by injecting LCN recycle at higher elevation. Therefore, optimum location could be decided based on what type of recycle stream could be recycled and riser bottom condition with respect to catalyst hold up, temperature and pressure. The catalyst used in this invention is typically Y-zeolite based FCC catalyst, preferably ultrastable Y zeolite catalyst with 5 to 30 wt % (of total catalyst inventory) of ZSM-5 additive. The catalyst with lower rare earth helps to produce more propylene as lower rare earth reduces hydrogen transfer reaction. The cracking of these stream are endothermic. As the quantity of feedstock at riser bottom is not more than 5 wt % of fresh feed, the temperature drop in this zone is not more 20° C.

The following experimental examples are presented for illustrative purposes only and are not to be taken as limiting the scope of the invention.

Properties of Light Cracked Naphtha (LCN) from FCC unit and Light Coker naphtha from Delayed Coker used in the following examples are given in the Table I below:

TABLE I

| Properties | Light cracked naphtha (FCC) | Light Coker Naphtha (Delayed Coker unit) |
|---|---|---|
| Specific gravity @ 15 degree C. | 0.724 | |
| Distillation, D86, Vol %/Degree C. | | |
| IBP | 60 | 37 |
| 5 | 68 | |
| 30 | 71 | 61 |
| 50 | 75 | 72 |
| 70 | 81 | 87 |
| 90 | 94 | 108 |
| 95 | 100 | |
| 99 | 110 | 134 |
| Olefin content, vol % | 36.58 | 55 |

Composition of $C_4$ raffinate i.e. olefinic $C_4$ hydrocarbon stream from naptha steam cracker used in the following examples is given in the Table II below:

TABLE II

| Composition | wt. % |
|---|---|
| Propane | 0.08 |
| Propylene | 0.02 |
| Iso butane | 7.04 |
| N butane | 9.33 |
| Propadiene | 0.04 |
| T but-2-ene | 7.44 |
| But-1-ene | 34.72 |
| Isobutylene | 35.68 |
| Cis but-2-ene | 4.72 |
| 1,3 butadiene | 0.84 |
| Un-identified | 0.09 |
| Total $C_4$ olefins | 83.4 |

Properties of catalyst used in the following examples are given in the following Table III:

TABLE III

| Properties | Unit | Equilibrium catalyst from high severity FCC unit |
|---|---|---|
| Pore Volume | cc/gm | 0.3 |
| Apparent Bulk Density | gm/cc | 0.858 |
| Total Surface Area | m.sup.2./gm | 148 |
| Chemical Analysis | | |
| Al sub 2O sub 3 | wt % | 43.31 |
| Ni | ppm | 800 |
| V | ppm | 1000 |
| Rare Earth oxide | wt % | 1.15 |
| Fe | wt % | 0.64 |
| Particle size distribution | Micron/wt % | |
| −120 | | 96 |
| −105 | | 91 |
| −80 | | 67 |
| −60 | | 37 |
| −40 | | 14 |
| −20 | | 4 |
| Apparent Particle Siz | microns | 70 |

EXAMPLE 1

Fixed bed, down flow micro reactor equipped with mass flow controller for maintaining accurate flow to the system, wet gas meter for measuring product flow and pressure control valve for controlling the pressure was used. The gaseous product was analyzed in gas chromatograph (HP6889). The reaction in micro reactor was carried out by imposing conditions that simulate typical riser bottom condition. The cracking reactions were carried out at 720° C. and pressure of 3.5 kg/cm.sup.2 (gauge) by varying WHSV from 5.88 to 22.68 hr up 1. The results were as given in the following Table IV:

TABLE IV

Yield distribution of light cracked naphtha

| Yield, wt. % | Delta yields between 22.68 WHSV and 5.88 WHSV |
|---|---|
| Ethylene | −7.3 |
| Dry gas | −13.8 |
| LPG except propylene | +9.3 |
| Propylene | +14.4 |
| $C_5$+ | −6.76 |

The above Table IV indicates that when WHSV with respect to recycle naphtha changes from 5.8 to 22.68 hr up 1, dry gas formation dropped by 13.8 wt % with increase in propylene make from 4.3 wt. % to 18.7 wt. %. In other words, when LCN is recycled in acceleration zone at higher elevation, it eventually increases WHSV and hence over cracking of recycle stream can be minimized leading to improvement of propylene selectivity substantially.

EXAMPLE 2

The reaction was carried out at different temperature and reactor pressure at 2.4 kg/cm.sup.2 (gauge) for generating effect of riser bottom temperature on cracking and product selectivity of light cracked naphtha. The results were as given in the following Table V:

TABLE V

Yield distribution of cracked naphtha.

| Temperature, ° C. | Delta yield between 650 and 600° C. | Delta yield between 700 and 650° C. |
|---|---|---|
| Yield, wt % | | |
| Ethylene | +7.6 | +0.4 |
| Dry gas | +10.6 | +5.3 |
| LPG except propylene | −6.2 | −2.3 |
| Propylene | +3.7 | −7.1 |
| $C_5$+ | −18.6 | +2.0 |

Table V shows propylene improvement to 29.4 wt. % from 22.3 wt. % when reaction temperature reduced to 650 from 700° C. However, further reduction in reaction temperature from 650° C. to 600° C. dropped conversion and hence propylene yield reduced from 29.4 wt. % to 25.7 wt. %. Therefore, the optimum temperature for LCN naphtha cracking is in the range of 650 to 700° C.

EXAMPLE 3

The cracking behavior of LCN from FCC and coker light naphtha were at 650° C. and 3 kg./cm.sup.2(gauge) at constant WHSV. The results were as shown in the following Table VI:

TABLE VI

Yield distribution of LCN vs. light coker naphtha

| Feed | Delta between Coker light Naphtha and LCN |
|---|---|
| Yield, wt % | |
| Ethylene | −3.0 |
| Dry gas | −7.50 |
| LPG except propylene | −3.47 |
| Propylene | −9.7 |
| $C_5$+ | +20.4 |

The above results indicate that crackability of coker light naphtha is inferior with respect to LCN from FCC unit. Coker light naphtha makes only 19.7 wt. % propylene vis-à-vis 29.4 wt. % from LCN. Relatively higher reaction severity is required for getting similar amount of propylene from coker light naphtha. This also suggests that coker light naphtha should be injected below the LCN injection point in the acceleration zone.

EXAMPLE 4

$C_4$ Raffinate from naphtha steam cracker given in Table II and LCN in Table I were cracked in micro reactor separately at 700° C., WHSV of 15.3 hr up 1 and pressure of 2.4 kg/cm.sup.2. The results were as shown in Table VII.

TABLE VII $C_4$ raffinate and LCN cracking comparison

| Yield, wt % | Delta yields between C.sub.4 raffinate and LCN |
|---|---|
| Ethylene | −1.2 |
| Dry gas | −14.0 |

TABLE VII-continued

| $C_4$ raffinate and LCN cracking comparison | |
|---|---|
| Yield, wt % | Delta yields between C.sub.4 raffinate and LCN |
| LPG except propylene | −24.0 |
| Propylene | +7.8 |
| C.sub.5+ | +13.0 |
| Coke | −4.6 |

The above results indicate that $C_4$ streams rich in olefin are better propylene selective than light cracked naphtha. At similar riser bottom condition, $C_4$ olefin raffinate reduces dry gas make by 14%, coke by 4.6% whereas propylene yield increases from 18.7 wt. % to 26.5 wt. %. In other words, $C_4$ olefin rich needs more reaction severity than LCN. Therefore, recycling of $C_4$ raffinate is more suitable than that of light cracked naphtha at riser bottom condition.

EXAMPLE 5

Another set of experiments were carried out for cracking of $C_4$ raffinate over fixed bed reactor as described above in Example 1 at WHSV of 15.3 hr sup 1 and 2.4 kg/cm sup 2(gauge) at three different reaction temperature. The results were as shown in Table VIII.

TABLE VIII

| $C_4$ raffinate cracking at different reaction temperature | | |
|---|---|---|
| Temperature, Deg. C. | Delta yield between 650° C. and 600° C. | Delta yield between 700° C. and 650° C. |
| Yield, wt % | | |
| Ethylene | +0.65 | +6.75 |
| Dry gas | +4.7 | +19.2 |
| Propylene | +1.0 | +2.5 |
| LPG(with out Propylene) | −3.6 | −25.0 |

Unlike LCN cracking, the above results indicate that the higher is the reaction temperature, the higher is the ethylene and propylene make from $C_4$ stream cracking.

These examples illustrate the need of different temperature and WHSV for optionally cracking various $C_4$ streams and various naphtha streams. These examples also show that unlike naphtha streams, the $C_4$ streams need high severity, which enables it to be injected at the bottom most point in the acceleration zone by replacing the lift steam/gas. Such replacement not only allows lower/no steam consumption at riser bottom and lesser catalyst deactivation but also provides a process for enhancing propylene and ethylene yield in any FCC unit within the existing gas and coke limits.

The invention claimed is:

1. A fluid catalytic cracking (FCC) process for manufacturing propylene and ethylene in increased yield, comprising cracking an olefinic naphtha stream and main hydrocarbon stock in combination with an olefinic $C_4$ hydrocarbon stream on a mixed FCC catalyst in an FCC unit having one or more risers, wherein each FCC riser comprises an acceleration zone at the lower portion thereof, a lift stream feed nozzle at the bottom of the acceleration zone, a main hydrocarbon stock feed nozzle above the acceleration zone and an olefinic naphtha feed nozzle at a location along the acceleration zone between the lift stream feed nozzle and main hydrocarbon stock feed nozzle, and wherein the catalyst comprises pentasil zeolite of 7 to 15 percent by weight and Y zeolite of 20 to 30 percent by weight and wherein the catalyst is injected at the bottom of each FCC riser, the olefinic naphtha is injected through the olefinic feed nozzle of each FCC riser, the main hydrocarbon stock is injected through the main hydrocarbon stock feed nozzle of each FCC riser and the lift stream is injected through the lift stream feed nozzle at the bottom of the acceleration zone of each riser, and wherein the lift stream comprises the olefinic $C_4$ hydrocarbon stream with or without steam and/or a fuel gas and wherein the olefinic $C_4$ hydrocarbon steam and olefinic naphtha stream and the main hydrocarbon stock are cracked in different zones of each FCC riser, the olefinic $C_4$ hydrocarbon stream and olefinic naphtha stream being cocracked in the acceleration zone of the riser and the main hydrocarbon stock being cracked above the acceleration zone at 600 to 800° C. and pressure of 0.8 to 5 $kg/cm^2$ (gauge) and weight hourly space velocity (WHSV) of 0.2 to 100 $hr^{-1}$ and vapour residence time of 0.2 to 5 seconds.

2. The process as claimed in claim 1, wherein the olefinic $C_4$ hydrocarbon stream is 5 to 15 wt % of the main hydrocarbon stock with a minimum olefin content of 30 vol % in the olefinic $C_4$ hydrocarbon stream.

3. The process as claimed in claim 1 or 2, wherein the olefinic $C_4$ hydrocarbon stream is from fluid catalytic cracking (FCC) unit, coker, vis-breaker or C4 raffinate from naphtha steam cracker or pure $C_4$ olefin stream or combination thereof.

4. The process as claimed in claim 1, wherein the olefinic $C_4$ hydrocarbon stream is cracked in the acceleration zone of each FCC riser at weight hourly space velocity (WHSV) of 1 to 40 $hr^{-1}$ at 600 to 750° C.

5. The process as claimed in claim 1, wherein the olefinic naphtha stream has olefin content of at least 20 percent by volume and comprises olefin rich sources from fluid catalytic cracking (FCC) or coker or naphtha cracker gasoline.

6. The process as claimed in claim 1, wherein the main hydrocarbon stock comprises gas oil (boiling point 120 to 360° C.), vacuum gas oil (boiling point 360 to 600° C.) and long or short hydrocarbon residues or mixture thereof.

7. The process as claimed in claim 1, wherein the main hydrocarbon stock comprises hydro-treated or untreated vacuum gas oil and/or petroleum residue selected from wax, fatty oil or plastics or combination thereof.

8. The process as claimed in claim 1, wherein the main hydrocarbon stock is cracked at different severity to maximize yields of diesel, gasoline, LPG (liquefied petroleum gas), propylene, ethylene or combination thereof.

9. The process as claimed in claim 1, wherein lift stream comprises only olefinic $C_4$ hydrocarbons steam for constant catalyst make up rate.

10. The process as claimed in claim 1, wherein the olefinic naphtha stream is cracked in the acceleration zone of each FCC riser at weight hourly space velocity (WHSV) of 20 to 30 $hr^{-1}$ and at 680° to 720° C.

11. The process as claimed in claim 1, wherein the olefinic $C_4$ hydrocarbon stream is cracked in the acceleration zone of each FCC riser at weight hourly space velocity (WHSV) of 2 to 20 $hr^{-1}$ and at 680° to 720° C.

12. The process as claimed in claim 1, wherein the pentasil zeolite in the catalyst is ZSM 5 zeolite.

* * * * *